US005622135A

United States Patent [19]

Eberline, Sr.

[11] Patent Number: 5,622,135

[45] Date of Patent: Apr. 22, 1997

[54] ANCHOR

[76] Inventor: William C. Eberline, Sr., 6378 Garfield, Cass City, Mich. 48726

[21] Appl. No.: 541,812

[22] Filed: Oct. 10, 1995

[51] Int. Cl.[6] ..... B63B 21/46

[52] U.S. Cl. ..... 114/299; 114/310

[58] Field of Search ..... 114/299, 304, 114/310

[56] References Cited

U.S. PATENT DOCUMENTS

| | | | |
|---|---|---|---|
| 2,612,131 | 9/1952 | Benedict | 114/299 |
| 2,722,191 | 11/1955 | Johnson | 114/299 |
| 3,024,756 | 3/1962 | Ogg | 114/310 |
| 4,210,092 | 7/1980 | Battersby | 114/299 |
| 4,545,318 | 10/1985 | Eberline | 114/299 |

*Primary Examiner*—Sherman Basinger

*Attorney, Agent, or Firm*—Barnes, Kisselle, Raisch, Choate, Whittemore & Hulbert

[57] ABSTRACT

An anchor with pivoted flukes and a track upon which an anchor line is slidably connected to the anchor has a pair of fluke drivers adjacent the flukes which produce a significant included angle of the flukes with respect to the bed of a body of water. This included angle of the flukes enables them to rapidly penetrate and set in a bed of a body of water even under hard pan bed conditions. Typically, the anchor sets into the bed of a body of water within ten feet of anchor movement relative to the bed.

13 Claims, 3 Drawing Sheets

ANCHOR

FIELD OF THE INVENTION

This invention relates to any anchors and more particularly to anchors with a sliding shackle.

BACKGROUND OF THE INVENTION

There has been a constant effort to improve the efficiency and practicality of boat anchors. A major advance in the art took place with the danforth anchor. The danforth anchor has flukes or blades pivoted in relation to the shank and may also include crown elements or plates positioned rigidly on the fluke structure. A recognized attribute with all pivoted fluke anchors and particularly those possessing crown elements is that the anchors are non-fouling in comparison to rigid traditional type anchors and much more easily retrievable when fouled on the bottom. The developement of loop or pocket shanks has also increased the retrievability of pivoted fluke anchors still further in the recent prior art. U.S. Pat. No. 4,545,318 discloses a pivoted fluke type anchor with a sliding shackle which enhances retrievability.

While these current anchor designs have been effective at improving retrievability of the anchor, they have been ineffective at quickly penetrating or setting in a hard pan bed condition. Current anchor designs can travel up to about two hundred yards before setting into a hard pan sand condition of the bed of a river, lake or ocean. This large distance needed to anchor the vessel may be unacceptable if the vessel is disabled or in other emergency situations. In addition, current anchors are susceptible to chine walking which is a severe condition that happens to high speed vessels that tip from side to side just before causing a turnover.

SUMMARY OF THE INVENTION

An anchor with pivoted flukes, an anchor line sliding shackle, and fluke drivers which orient the flukes so that they readily and rapidly penetrate the bed of a body of water. As the anchor is lowered onto the bed, the fluke drivers contact the bed and as the anchor is initially advanced along the bed, the drivers incline the flukes toward the bed with their tips bearing on the bed so that they penetrate and are driven into the bed as the anchor is advanced.

Preferably the drivers are pivotally mounted adjacent the trailing end or back of the flukes so that as the anchor is initially advanced, the drivers rotate and raise the back of the flukes so that their tips immediately penetrate and are forced into the bed by advancement of the anchor. Usually, the flukes have penetrated and become fully set in the bed within 10 feet of anchor movement.

To release the anchor, the anchor line is retracted as the boat moves so that it generally overlies the anchor and upon further retraction, the anchor line causes the shackle to slide toward the back of the flukes behind their point of entry into the bed to produce force with a substantial upward component behind this entry point to withdraw the flukes from the bed. The drivers facilitate removal of the flukes from the bed by keeping the backs of the flukes generally vertically above their tips until the flukes are completely withdrawn from the bed.

Objects, features and advantages of this invention include providing a light weight anchor with a pair of fluke drivers that enhances the digging or setting of the anchor into the bed of a body of water, is relatively non-fouling when compared to prior anchors, is easily retrievable when fouled on the bed, readily and rapidly digs into even hard pan surfaces within a few feet of anchor movement, provides improved safety in setting and retrieving anchors, automatically resets into the bed of a body of water if the winds or tides change, is retrievable without having to power the boat in a direction opposite to the direction in which the anchor was set, is of relatively simple design, economical manufacture and assembly, and in service is rugged, durable, maintenance free and has a long useful life.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENTS

Figure 1:
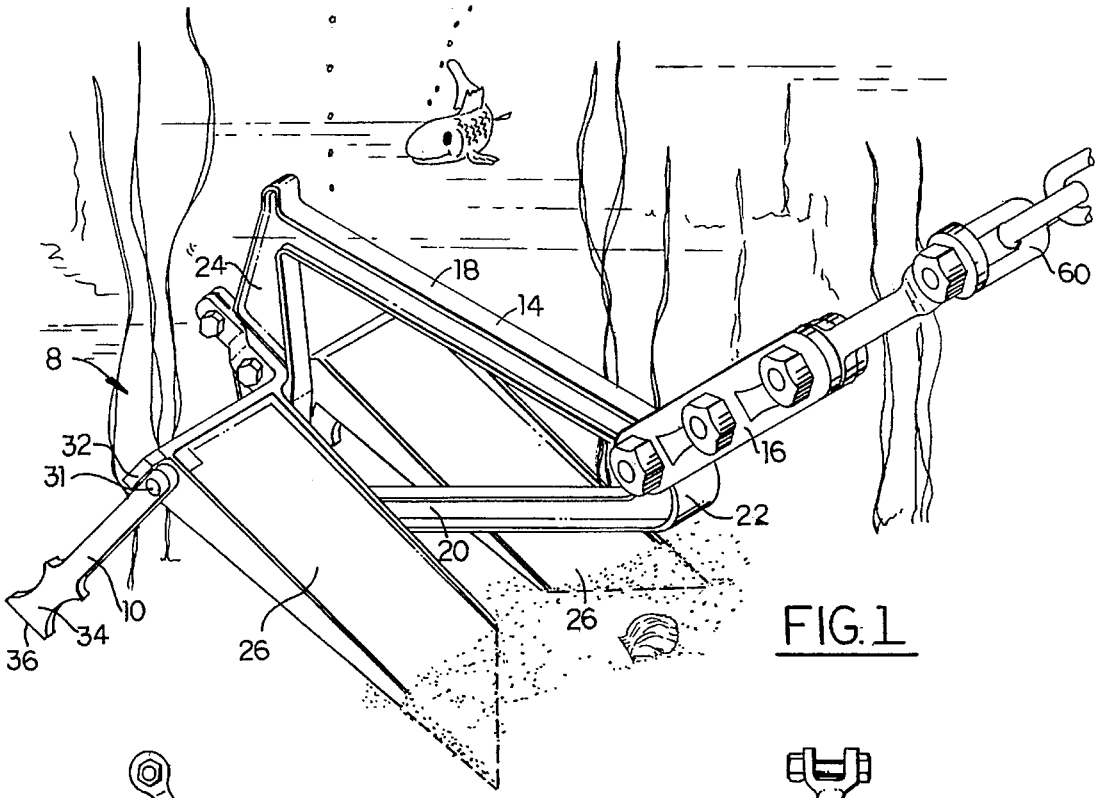
FIG. 1 is a schematic view of an anchor embodying this invention in use after being set into the bed of a body of water.
Figure 2:
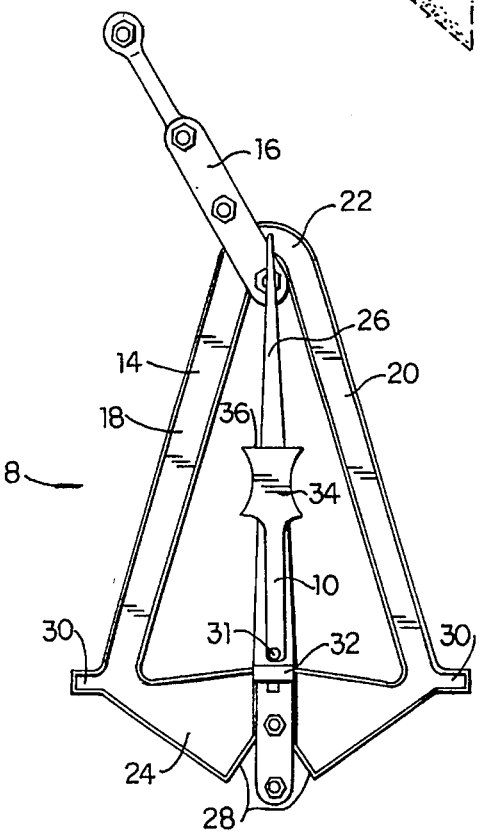
FIG. 2 is an end view of the anchor.
Figure 3:
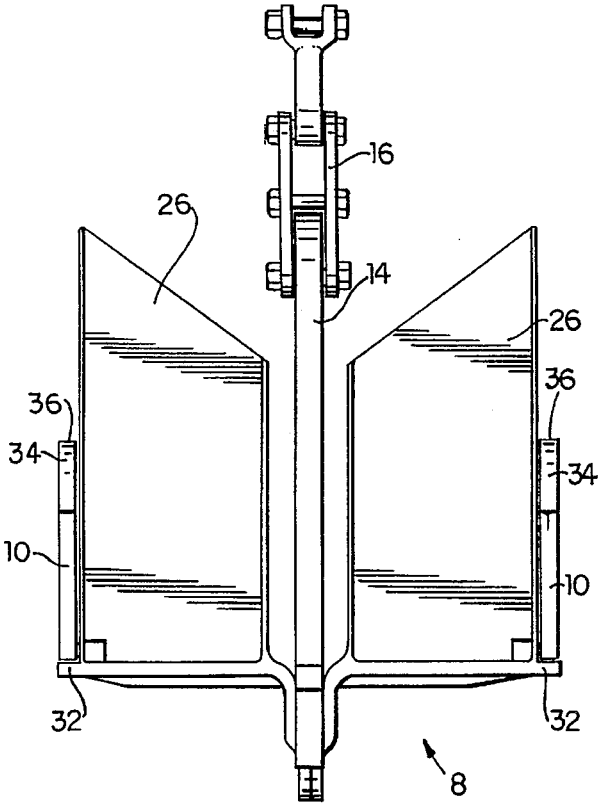
FIG. 3 is a side view of the anchor.

FIGS. 1, 2 and 3 illustrate an anchor 8 embodying a presently preferred embodiment of the invention with a pair of fluke drivers 10 pivotally carried by the anchor. The anchor has a track 14 upon which a slide member 16 for an anchor line moves. The track 14 has a pair of legs 18, 20 inclined at an acute included angle and interconnected by a return bend 22 enabling the slide 16 to move along one leg 18 of the track 14, around the return bend 22, and onto the other leg 20 of the track 14. The ends of the legs 18, 20 distal from the return bend 22 are connected by a carrier member 24 that extends generally transverse to the bisector of the included angle of the legs 18, 20. A pair of anchor flukes or blades 26, pivotally carried by the carrier member 24, extend longitudinally in the direction of the return bend 22. The carrier member 24 has a notch providing stops 28 to limit the pivotal movement of the anchor blades 26. The carrier member 24 also has a pair of projections or stops 30, adjacent the legs of the track 18, 20, to prevent the slide 16 from moving onto the carrier member 24.

The drivers 10 are spaced apart and pivoted on stub shafts 31 adjacent the outer edges of the flukes 26 and can each rotate about 180° as limited by an overhang or stop 32 on each fluke. The stops 32 limit the rotation of the fluke drivers about an axis that is generally transverse to the longitudinal axis of the anchor blades 26 and the track 18. By rotating about 180° the drivers 10 can function in the same manner regardless of which side of the anchor 8 is in contact with the bed of the body of water.

To allow each fluke driver 10 to contact the bed of a body of water with a sloped or uneven surface, preferably, the fluke drivers 10 rotate independently of each other. To insure each fluke driver 10 will rotate into contact with the bed, preferably each fluke driver 10 has a weighted foot portion 34 which causes the fluke driver 10 to rotate downward due to gravity, into contact with the bed. Also preferably, the foot portion 34 of the fluke driver 10 has a bottom face 36 with an area sufficient to retard the fluke driver 10 from significantly penetrating into the bed of the body of water. This maximizes the height the anchor 8 achieves when it rotates about the fluke drivers 10, and thus, maximizes the angle of the anchor blades 26 relative to the bed of the body of water.

Preferably the fluke drivers have a length greater than the distance from their pivot pin to the edges of the stop 30 and sufficient when bearing on their stop 32 to incline the flukes 26 (as shown in FIG. 2) at an acute included angle to the bed which is usually in the range of about 20° to 45° and preferably 25° to 35°.

Operation

Figure 4:
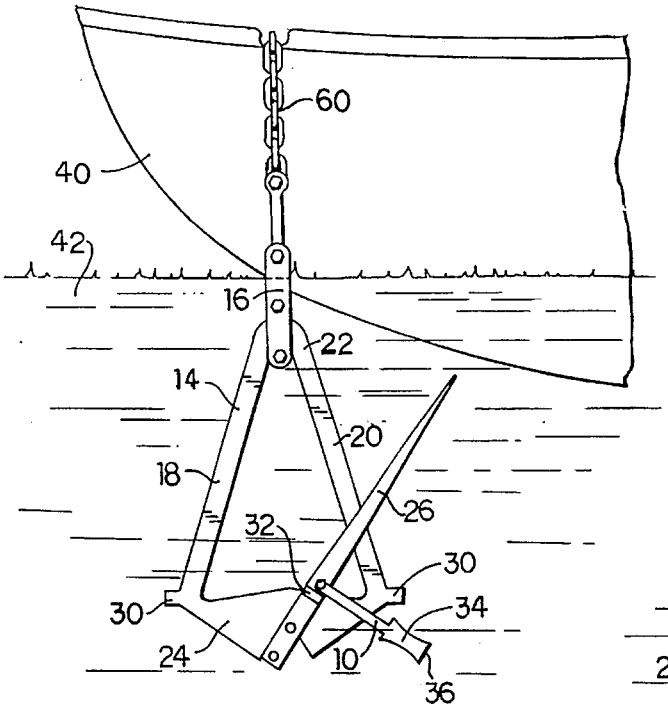
FIG. 4 is an end view of the anchor as it is being lowered in the water.

As shown in FIG. 4, as the anchor 8 is lowered from the boat 40 into the water 42 on an anchor line 60 it typically hangs with the slide 16 at the return bend 22. The flukes 26 and drivers 10 are rotated downward due to gravity until they contact their respective stops 28, 32. When the anchor 8 finally reaches the bed 50 of the body of water it falls on one side or the other depending on the movement of the boat 40. Since the anchor 8 is a mirror image of itself along the bisector of the acute included angle of the legs 18, 20 of the track 14, it functions in the same manner regardless of which side of the anchor 8 settles on the bed of the body of water.

Figure 5:
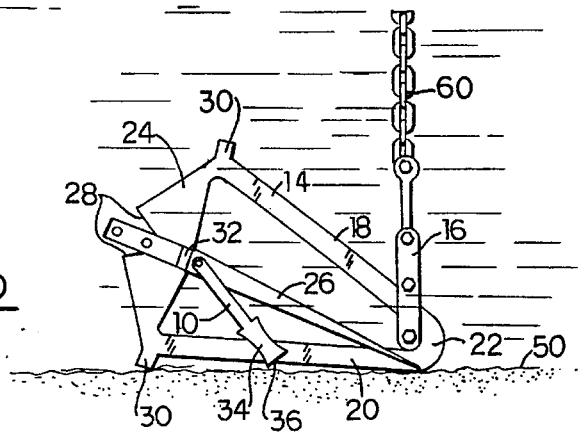
FIG. 5 is an end view of the anchor as it first rests on the bed of the body of water.

As shown in FIG. 5, when the anchor 8 settles on the bed 50 of the body of water the flukes 26 and the drivers 10 rotate downward, due to gravity, into contact with the bed. From this position, with further advancement or the anchor by movement of the boat 40, the free ends of the drivers 10 remain relatively stationary in relation to the bed 50 and the anchor flukes and track rotate about, or "walk over" the fluke drivers 10. This causes at least the back or base portion of the flukes to be raised up and supported by the fluke drivers 10. Due to gravity the tips of the flukes 26 tend to stay on or near the bed 50 of the body of water as the back portion of the flukes are raised off of the bed 50.

Figure 6:
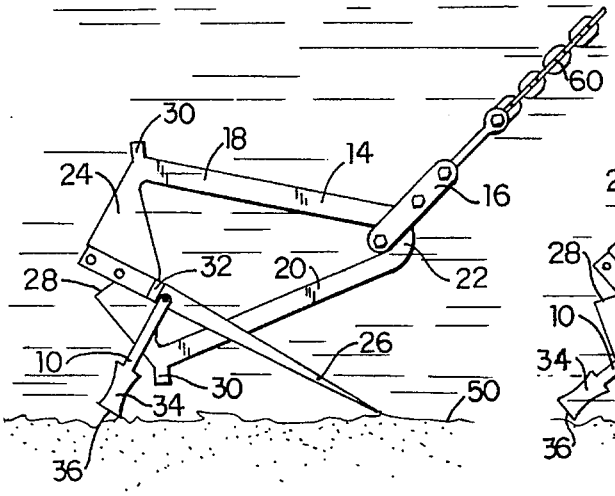
FIG. 6 is an end view of the anchor showing the anchor as it "walks over" or moves about the fluke driver.
Figure 7:
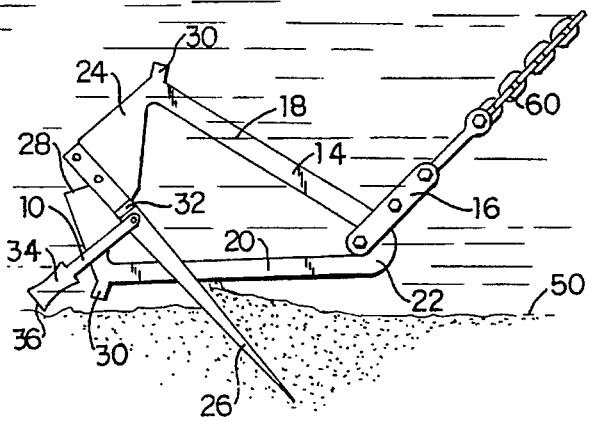
FIG. 7 is an end view of the anchor as the flukes dig into the bed of the body of water.

FIG. 6 shows the anchor 8 as it has just completed "walking over" the fluke driver 10. This action of walking over the fluke driver 10 increases the angle of the anchor flukes 26 with respect to the bed 50 of the body of water. The anchor flukes 26 are generally are at a maximum angle with respect to the bed 50 when the drivers 10 are perpendicular to the bed of the body of water. This increased angle increases the tendency of the flukes 26 to pierce and dig into the bed 50 as the anchor is further advanced along the bed. The angle of the flukes 26 causes them to rapidly penetrate the bed 50 of the body of water, as shown in FIG. 7, rather than merely sliding or scraping along the surface of the bed.

Figure 8:
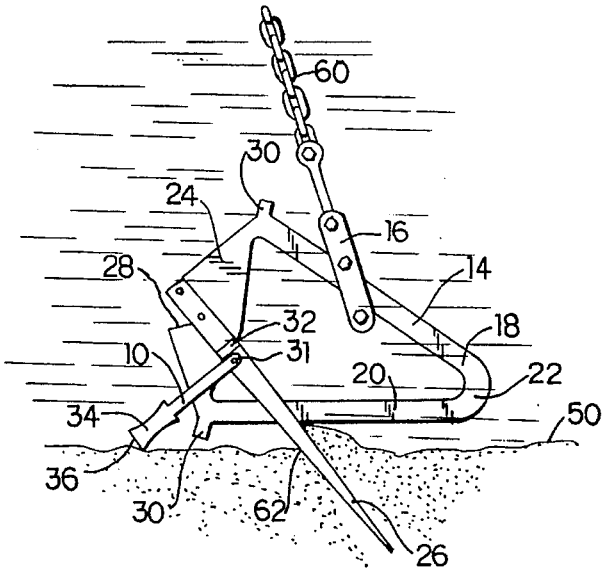
FIG. 8 is an end view of the anchor as the line slides toward the base of the anchor.
Figure 9:
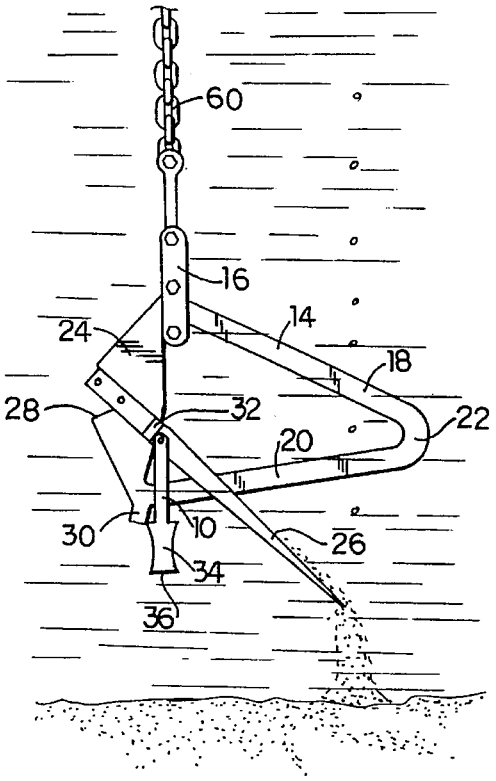
FIG. 9 is an end view of the anchor showing the anchor as it is being raised back toward the boat after being released from its set position in the bed.

To retrieve the anchor 8, the boat 40 does not have to be moved beyond the anchor 8 in the opposite direction from which it dug in, and was set in the bed. The anchor line 60 is retracted, preferably by a power or manual winch which winds up the anchor line 60 and pulls the boat 40 to a location generally above the anchor 8. As the boat approaches a position above the anchor 8, the slide 16 moves along the track 14 until it passes beyond the point 62 where the flukes pierced the bed 50 (as shown in FIG. 8) and into engagement with a stop 30. Continued retraction of the anchor line 60 pulls the back of the flukes 26 upward and generally in a direction opposite to the direction in which the flukes were set into the bed 50, releasing the anchor from the bed. Thus, as shown by the relatively vertical anchor line 60 of FIG. 9, the boat does not need to pass substantially beyond the anchor 8 in order to retrieve the anchor from the bed 50 of a body of water.

If the winds or tides change while the boat is anchored and the boat moves back over the anchor location or further, in the opposite direction to which the anchor 8 was initially set, the anchor 8 may be pulled out of the bed 50 of the body of water. In this situation, continued movement of the boat, in any direction, will reset the anchor into the bed as described above. This will happen because the anchor is a mirror image of itself about the bisector of the included angle between the legs 18, 20 of the track 14 and thus, it functions in the same manner regardless of which leg of the track is above the bed 50 of the body of water. Therefore, even if the anchor is flipped over due to a change in boat location, it will still be able to reset itself automatically and virtually immediately.

The drivers on a pivoted fluke anchor produce a significant included angle of the flukes with respect to the bed of a body of water. This included angle of the flukes enables them to rapidly penetrate and set in a bed even under hard pan bed conditions. This allows the anchor to set into the bed in a relatively short distance, usually within ten feet of anchor movement on the bed. This is a vast improvement over current anchor designs which require the anchor to move up to two hundred yards to set in rocky or hard pan bed conditions. Also, the pivotal mounting of the flukes along with the sliding arrangement of the anchor line attachment allows for retrieval of the anchor from the bed without having to power the boat substantially beyond the anchor in a direction opposite to that in which it was set.

What is claimed is:

1. An anchor which comprises: at least one fluke, a track pivotally carried by said fluke adjacent one end of said fluke and extending toward the other end of said fluke, a stop which limits the pivoting of said track relative to said fluke, a slide carried by said track and constructed and arranged to connect a flexible anchor line to the anchor, a pair of fluke drivers candied by the anchor to pivot about an axis extending generally transversely to said track and located adjacent the one end of said fluke, another stop adjacent said fluke drivers to limit pivotal movement of said drivers relative to said fluke and each said fluke driver when bearing on said another stop extends substantially transversely of said fluke and projects outwardly of said fluke and said track with an end distal from said fluke disposed outwardly transversely beyond said track and when the distal ends of the fluke drivers and the other end of the fluke are received on a bed of a body of water the fluke is inclined by the drivers while bearing on said another stop at an acute included angle to the bed of about 20° to 45°.

2. The anchor of claim 1 wherein said stops limit said drivers to about 180° rotation.

3. The anchor of claim 1 wherein said drivers rotate independently of each other.

4. The anchor of claim 1 wherein said drivers have a bottom face with an area sufficient to retard said drivers from significantly penetrating the bed of a body of water.

5. The anchor of claim 1 wherein said drivers have a weight distal from the pivot of said drivers which causes said drivers to rotate downward due to gravity, into contact with the bed of a body of water.

6. The anchor of claim 1 wherein said track has a pair of legs inclined at an acute included angle and interconnected by a return bend distal from the pivot point of the track.

7. The anchor of claim 6 wherein a carrier member extends generally transversely to the bisector of the included angle of the legs of said track and said carrier member and said fluke are pivotally connected.

8. An anchor which comprises: a pair of flukes, a track pivotally carried between said flukes adjacent one end of said flukes and extending toward the other end of said flukes, a stop which limits the pivoting of said track relative to said flukes, a slide carried by said track and constructed and arranged to connect a flexible anchor line to the anchor, a pair of fluke drivers carried by the anchor to pivot about an axis extending generally transversely to said track and located adjacent the one end of said flukes, another stop adjacent said fluke drivers to limit pivotal movement of said drivers relative to said flukes and each said fluke driver when being on said another stop extends substantially transversely of said flukes and projects outwardly of said flukes and said track with an end distal from said flukes disposed outwardly transversely beyond said track and when the distal ends of the drivers and the other ends of the flukes are received on a bed of a body of water the flukes are inclined by the drivers while bearing on said another stop at an acute included angle to the bed of about 20° to 45°.

9. An anchor which comprises: at least one fluke, a track pivotally carried by said fluke adjacent one end of said fluke and extending toward the other end of said fluke, a stop which limits the pivoting of said track relative to said fluke, a slide carried by said track and constructed and arranged to connect a flexible anchor line to the anchor, a pair of fluke drivers carried by the anchor, extending generally transversely to said fluke and located adjacent the one end of said fluke, another stop adjacent said fluke drivers to limit pivotal movement of said fluke drivers and each said fluke driver when bearing on Said another stop extends substantially transversely of said fluke and projects outwardly of said fluke and said track with an end distal from said fluke disposed outwardly transversely beyond said track and fluke and when the distal ends of the drivers and the other end of the fluke are received on a bed of a body of water the fluke is inclined by the drivers at an acute included angle to the bed of about 20° to 45°.

10. The anchor of claim 1 which has a pair of flukes and each fluke driver is carried by the anchor adjacent an outer side edge of an associated fluke, and each fluke driver has an elongate body which adjacent one end is pivotally carried by the anchor and adjacent the other end is constructed to bear on a bed of a body of water when the anchor is received on the bed.

11. The anchor of claim 8 wherein each fluke driver is carried by the anchor adjacent an outer side edge of an associated fluke, and each fluke driver has an elongate body which adjacent one end is pivotally carried by the anchor and adjacent the other end is constructed to bear on a bed of a body of water when the anchor is received on the bed.

12. The anchor of claim 1 which has a pair of flukes and each fluke driver is carrier by the anchor adjacent an outer side edge of an associated fluke, each fluke driver has an elongate body which adjacent one end is pivotally carried by the anchor and adjacent the other end is constructed to bear on a bed of a body of water when the anchor is received on the bed, and each fluke driver adjacent said one end bears on an associated said another stop when it extends substantially transversely from either side of its associated fluke.

13. The anchor of claim 8 wherein each fluke driver is carried by the anchor adjacent an outer side edge of an associated fluke, each fluke driver has an elongate body which adjacent one end is pivotally carried by the anchor and adjacent the other end is constructed to bear on a bed of a body of water when the anchor is received on the bed, and each driver adjacent said one end bears on an associated said another stop when it extends substantially transversely from either side of the same fluke.

* * * * *